United States Patent [19]

Flagg

[11] 4,129,303

[45] Dec. 12, 1978

[54] CUBIC GAME BOARD

[76] Inventor: John G. Flagg, 19 E. Shore Dr., Babylon, N.Y. 11702

[21] Appl. No.: 783,149

[22] Filed: Mar. 31, 1977

[51] Int. Cl.[2] ..... A63F 3/00

[52] U.S. Cl. ..... 273/241; 273/282; 273/280

[58] Field of Search ..... 273/130 AC, 131 AC, 273/131 A, 131 AD, 131 AB, 131 BA, 131 KN, 131 KP, 136 C, 136 E, 241, 287, 282, 280

[56] References Cited

U.S. PATENT DOCUMENTS

| | | | |
|---|---|---|---|
| 2,244,762 | 6/1941 | Braymiller et al. | 273/131 AB |
| 2,727,745 | 12/1955 | Jenkins | 273/131 BA |
| 2,940,760 | 6/1960 | Brinkman, Jr. | 273/130 AC |
| 3,359,003 | 12/1967 | Kass | 273/131 AC |
| 3,430,962 | 3/1969 | Davenport | 273/136 K |
| 3,623,729 | 11/1971 | Wetherell | 273/130 AC |
| 3,672,679 | 6/1972 | Burns | 273/136 C |
| 3,771,795 | 11/1973 | Flanigen | 273/157 R |
| 3,888,487 | 6/1975 | Replogle | 273/130 AC |
| 4,009,882 | 3/1977 | Rader | 273/130 AC |

FOREIGN PATENT DOCUMENTS

| | | | |
|---|---|---|---|
| 1160120 | 7/1969 | United Kingdom | 273/130 AC |

*Primary Examiner*—Richard C. Pinkham
*Assistant Examiner*—Harry G. Strappello
*Attorney, Agent, or Firm*—Nims, Howes, Collison & Isner

[57] ABSTRACT

A game board for adversary move and countermove type games in the form of a cube presenting six playing surfaces each including a plurality of holes arranged in a rectangular matrix pattern of not less than three by three nor more than five by five holes therein, each of said holes being adapted to releasably retain a manually displaceable pin member thereon.

2 Claims, 3 Drawing Figures

CUBIC GAME BOARD

This invention relates to a game board and particularly to a cubic game board presenting six discrete playing surfaces for the multi-participant playing of three dimensional multi-move games.

Conventional game boards are normally two dimensional structures which present a planar surface for permitted movement of a marker or other player identifying member from one point to another thereon in accord with the rules of a particular game. In such environment, conceptualization of moves and countermoves in an adversary contest are restricted to possible combinations of two dimensional movements within a single plane. Further, two dimensional planar playing surfaces inherently limit the number and variety of adversary type games that can be played thereon.

The invention may be briefly described as an improved game board for move and countermove adversary type games in the form of a cube presenting six playing surfaces, each including a plurality of bores arranged in a rectangular matrix pattern of not less than three by three nor more than five by five bores together with a plurality of manually displaceable pin members releasably retainable in said bores. In its narrow aspects the subject invention also includes the incorporation of visually sensible indicia on said playing surfaces for selectively identifying each of said surfaces and permitted paths of manual displacement of the pin members relative to the bores and to the defining edges of the cube.

The primary object of this invention is the provision of an improved game board for move and countermove adversary type games.

Another object of this invention is to provide an improved three dimensional game board for the playing of varied move and countermove adversary type game.

A further object is to provide a six surface game board and mount therefore that locates the playing surfaces in readily visable and physically accessible position.

Other objects and advantages of the subject invention will become apparent from the remaining portions of this specification and from the appended drawings which illustrate a presently preferred embodiment of a game board incorporating the principles of this invention.

Referring to the drawing.

Figure 1:
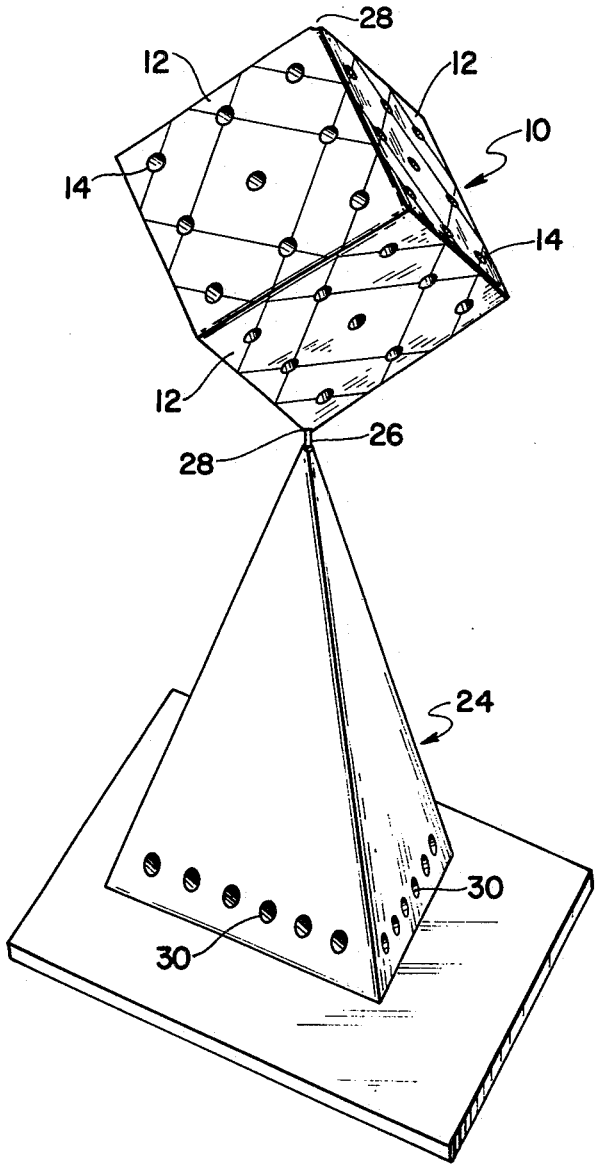
FIG. 1 is an oblique view of game board constructed in accord with the principles of this invention and as positioned in space by a supporting standard.
Figure 3:
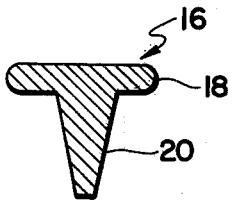
FIG. 3 is a vertical sectional view of a pin type marker member suitable for use with the game board of FIGS. 1 and 2.
Figure 2:
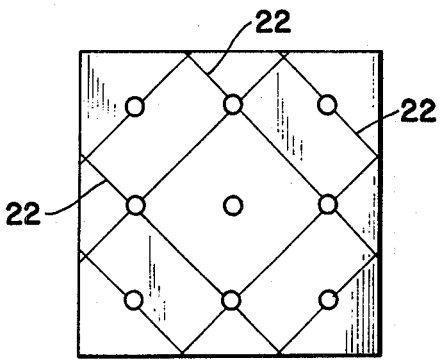
FIG. 2 is a plan view of one playing surface.

Referring to FIG. 1, there is provided an improved three dimensional game board for move and countermove adversary type games in the form of a cube 10 presenting six discrete playing surfaces 12 of uniform character. Each of the playing surfaces 12 includes a plurality of perpendicular bores or holes 14 therein arranged in a rectangular matrix pattern of not less than three by three nor more than five by five bores therein. Releasably retainable within bores 14 are manually displaceable pin type marker members 16 suitably of a shape such as illustrated in FIG. 3. As there set forth, each of the pin members includes an enlarged head portion 18 and a dependent body portion 20 which is desirably of tapered configuration so as to provide reasonably secure frictional retention thereof within a bore 14 and yet facilitate ready manual removal therefrom and relocation during play.

Each of the playing surfaces 12 is distinctively colored, numbered, illustrated or provided with other readily observable indicia for selective identification thereof by the players. Additionally each of said playing surfaces contains a plurality of direction lines, such as the diagonally disposed straight lines 22 (See FIG. 3) drawn through the centers of adjacent bores 14 and extending over the defining edges of the cube 10 to delineate some of the permitted paths of manual displacement of pin members 16 relative to said playing surfaces.

As will now be apparent, the described construction effectively presents six discrete and readily distinguishable playing surfaces 12 each containing a predetermined pattern of pin receiving bores 14 therein to compositely constitute a three dimensional game board on which move and countermove adversary type games of varying types may be participated in by a number of players.

Because of the three dimensional character of the game board, play thereon requires ready displacement or manipulation thereof to permit players to view all of its playing surfaces. Such objective is conveniently obtained by supporting the cube in free space in such manner as to permit rotational displacement thereof. Such end is obtained by an associated wide base, small apex supporting standard, such as a cone or pyramid 24. As shown in FIG. 1, the apex of the pyramid 24 includes an upwardly extending pin 26 sized to be received within a diametrically disposed bore 28 located in at least two diametrically opposed corners of the cube 10. In use, and as shown in FIG. 1, the supporting standard is positioned on a table or the like and the cube 10 is mounted on the apex thereof with the pin 26 and bores 28 being sized to permit rotational displacement of the cube. When so mounted and positioned, the cube 10 will be effectively positioned in space with all playing surfaces 12 thereof being readily visible and physically accessible for manual pin displacement by the players.

The supporting standard 24 may additionally serve, through the inclusion of bores 30 therein, as a pin member 16 storage facility during play. The cube 10 may be formed of any suitable material such as wood, cork, synthetic resins or the like. Likewise, the pin elements 16 may take any desired configuration or may be color-coded to provide for selective player identification. Any suitable means for releasable pin retention within the bores 14, such as magnetic interengagement, snap fastening or simple screw threads, may be employed.

Having thus described my invention, I claim:

1. A game board for adversary and countermove type games comprising a cube presenting six planar playing surfaces of uniform character, each of said planar surfaces including a plurality of bores arranged in a rectangular matrix pattern of not less than three by three nor more than five by five bores therein, a plurality of pin members each releasably retainable in a bore, visually sensible indicia on said planar playing surfaces for selectively identifying each of said planar playing surfaces, a bore disposed at a corner of said cube, and a supporting standard upwardly terminating in an extending pin member receivable within the bore located at a corner of said cube for positioning said cube in space with each planar playing surface being readily visable and physically accessible for pin displacement relative thereto and further having bores therein for receiving the pin members for storage during game play.

2. A game board as set forth in claim 1, including visually sensible indicia on said planar playing surfaces selectively identifying permitted paths of manual displacement of said pin members relative to said bores and to the defining edges of said cube.

* * * * *